US005214705A

United States Patent [19]

Kloker et al.

[11] Patent Number: 5,214,705

[45] Date of Patent: May 25, 1993

[54] CIRCUIT AND METHOD FOR COMMUNICATING DIGITAL AUDIO INFORMATION

[75] Inventors: Kevin L. Kloker, Arlington Heights; Thomas L. Wernimont, Palatine, both of Ill.

[73] Assignee: Motorola, Schaumburg, Ill.

[21] Appl. No.: 769,307

[22] Filed: Oct. 1, 1991

[51] Int. Cl.[5] ..... H04H 5/00

[52] U.S. Cl. ..... 381/2; 375/25; 370/110.1; 370/110.4

[58] Field of Search ..... 381/2; 375/25; 370/110.1, 110.4; 379/88

[56] References Cited

U.S. PATENT DOCUMENTS

| | | | |
|---|---|---|---|
| 4,787,085 | 11/1988 | Suto et al. | 381/2 |
| 4,821,260 | 4/1989 | Klank et al. | 370/110.4 |
| 5,003,557 | 3/1991 | Fujiyama | 381/2 |
| 5,051,799 | 9/1991 | Paul et al. | 375/25 |

OTHER PUBLICATIONS

"AES Recommended Practice for Digital Audio Engineering-Serial Transmission Format for Linearly Represented Digital Audio Data" published by Audio Engineering Society in 1985, pp. 1-9.

"CP-340 Digital Audio Interface" published by the Standards of Electronic Industries Association of Japan in Sep. of 1987, pp. 1-32.

*Primary Examiner*—Jin F. Ng
*Assistant Examiner*—Edward Lefkowitz
*Attorney, Agent, or Firm*—Elizabeth A. Apperley

[57] ABSTRACT

An interface circuit (16, 44) is provided for communicating a plurality of demodulated digital audio values in a predetermined serial data bus protocol between a digital source (12) and a digital sink (46). Each of the plurality of digital audio values contains either left or right channel audio information and control values. The serial data bus protocol is formed by the interface circuit (16, 44) by transmitting a left channel information value of a predetermined demodulated digital audio value, a right channel information value of the predetermined demodulated digital audio value, and then a byte of control information formed from both the left and right channel control values.

17 Claims, 3 Drawing Sheets

FIG.2

CIRCUIT AND METHOD FOR COMMUNICATING DIGITAL AUDIO INFORMATION

FIELD OF THE INVENTION

This invention relates generally to a communications system, and more particularly to serial data bus protocols in a communications system.

BACKGROUND OF THE INVENTION

In a digital communications system, digital audio data and control information is transmitted in a predetermined serial transmission format such as AES-EBU or CP-340. The AES-EBU format (Audio Engineering Society/European Broadcast Union) was developed for professional digital audio and the CP-340 format was developed for both commercial and professional digital audio. Both the AES-EBU and CP-340 formats were developed for serial transmission of two channels, each having digital audio data and non-audio, or control, data from a transmitter to one or a plurality of receivers.

The AES-EBU format transmits digital audio and non-audio data in a series of frames. The digital audio and non-audio data is typically sampled periodically by a source frequency and formed into a left audio or a right audio channel of two's complement data. The left and the right channels of digital audio and non-audio data each form a subframe. The digital audio and non-audio data is transferred in a Manchester encoded format. Manchester encoding allows information transferred in the digital audio and non-audio data to be contained in a transition from a low value to a high value, or vice versa, in any one period of the source frequency. For example, if a transition from a low value to a high value occurs during a source frequency period, a logic one is transferred. Conversely, if a transition from one electrical level to another electrical level does not occur during the source frequency period, a logic zero is transferred.

Two subframes, one for left channel information and a second for right channel information, are transmitted in sequence in any one period of the source frequency. The two subframes may also be collectively referred to as a frame. In the AES-EBU format, each subframe has a length of thirty-two time slots, where each time slot corresponds to a data bit of digital audio or non-audio information. Typically, the first four bits of each subframe are preamble bits. Preamble bits are encoded to synchronize a receiver to the source frequency of the transmitter. The next twenty-four bits transfer audio data information in two's complement form. A next bit is generally referred to as a validity (V) bit. The V bit indicates if the previous audio data information was transmitted to the receiver without any errors. The V bit is a logic zero level when the audio data information is valid, and a logic one level when the audio data information was transmitted with errors. Subsequently, a next bit is the user (U) data bit. The U bit contains user data which is associated with either the left or right audio channel. A following bit is the channel status (C) bit. The C bit is used to form a group of data bits to control transmission of audio and control information. For each of the left and right audio channels, a block is formed by accessing the C bit of each of 192 successive frames. A start of the block is identified by the preamble of the subframes. The last of the thirty-two bits of a subframe is the (P) parity bit. The P bit indicates even parity of the subframe currently transmitted. Therefore, the P bit is used to easily detect transmission errors and may be used to determine channel reliability.

The CP-340 format is very similar to the AES-EBU format. However, while incorporating a structure similar to the AES-EBU format, the CP-340 format also supports transmission of digital audio data in commercial applications. For increased versatility, CP-340 has several types of status formats. The status formats include Type I for use in broadcasting studios, Type II/-Form I for use in consumer applications such as compact discs and digital audio tapes, and Type II/Form II for use in prerecorded programs. Because several types of status formats are provided, a level of accuracy for the sampling frequency must also be provided for each type of status format. Two data bits must be transmitted with the digital audio and control information data bits to indicate the level of accuracy for the sampling frequency. A first level corresponds to Type I status formats which require a high level of sampling frequency accuracy. Type II/Form I may use a sampling frequency with a Level II accuracy. Level II provides the minimum conditions which should be provided to any digital audio equipment. A level III sampling frequency accuracy is used when a variable pitch shift system is used in the transmission equipment.

For more detailed information on the AES-EBU format, refer to "AES Recommended Practice for Digital Audio Engineering-Serial Transmission Format for Linearly Represented Digital Audio Data" published by the Audio Engineering Society in 1985. Similarly, for information concerning the CP-340 format, refer to "EIAJ CP-340 Digital Audio Interface" published by the Standards of Electronic Industries Association of Japan in 1987.

Both the AES-EBU and CP-340 formats are commonly used for transmitting digital audio and non-audio between a compact disc player, a digital audio tape player, an audio mixing board, studio recording equipment, and consumer musical instruments. Because of the wide applications of the AES-EBU and CP-340 formats for transmission of audio information, it is useful for a digital signal processor to also be compatible with this digital audio format. When transferring digital audio information from a transmitter, such as a compact disc player or a digital audio tape player, and a digital signal processor, the digital data is typically provided to an interface receiver where it is modified to a form in which it may be used by the digital signal processor.

In the interface receiver, audio and non-audio data is received and converted into words of digital information with typical word lengths which are a multiple of eight bits, or a byte. For example, typical word lengths may be either sixteen or twenty-four bits. The words of digital information are easily transmitted to and received by a digital storage circuit, such as a digital signal processor, when formed into one of the typical word lengths.

Generally, audio and non-audio data corresponding to a left channel is first transmitted, and audio and non-audio data corresponding to a right channel is subsequently transmitted. As previously mentioned, the audio information is usually transferred in one of the typical word lengths which may be easily transmitted to an processed by the digital storage circuit. However, the non-audio data for each channel generally consists of only four bits-the V bit, the U bit, the C bit, and the P bit. Therefore, if the non-audio data for each channel is transmitted serially in a byte format, at least four bits of information are not used during transmission of each subframe. Consequently, during transmission of a frame of information, eight bits of information are unused for each frame of digital data. Because transmission of digital audio and non-audio data typically requires a significant number of frames of digital information, the bits which are not used form a substantial portion of the transmitted data.

To compensate for lost bandwidth when only four bits of non-audio digital data for each channel are transmitted, several techniques have been developed. For example, software programs are sometimes provided to service non-audio digital information. However, software programs require a significant amount of overhead time to execute the multiple interrupts, shifts, and initiation routines necessary to service serially transmitted non-audio digital information. When transmitted serially, the non-audio digital information is typically transferred via the same hardware channel as the audio digital information. Subsequently, the audio and non-audio digital information must be separated in the digital signal processor by extra shift and mask operations which require an extensive amount of processing time. The non-audio digital information may also be serially transferred to the digital signal processor by using an interface circuit to separate the non-audio information from the audio information. The interface circuit, however, requires extensive and complex circuitry to separate the non-audio information from the audio information in a timely manner. Therefore, current implementations of an interface circuit are generally very awkward and result in higher overhead costs.

Additionally, another technique for transferring non-audio digital data transmits each of the four bits of the non-audio digital information in parallel. The four bits of the non-audio digital data may be transferred either concurrently or separately with the transfer of corresponding audio digital data. However, a user of the digital signal processor must then be able to sacrifice at least four pins for receipt and transmission of the non-audio digital information. As well, the non-audio digital information corresponding to the left and right channels is transferred to the digital signal processor at two different times. The digital signal processor is then required to provide a software program to compensate for transferring a non-audio digital value corresponding to a right audio channel at two separate times. Similarly, a hardware circuit may also be needed to allow the two non-audio digital values corresponding to the left and right audio channels, respectively, to be processed correctly when received at two separate times. Again, overhead costs and efficiency are sacrificed.

Whether the non-audio digital information is transferred serially or in parallel, a significant amount of overhead cost and processing time is expended during the transmission of digital information to a digital signal processor. Therefore, a need exists to shorten the time necessary to process non-audio digital information in any data processing system, but especially in a digital signal processor. Additionally, a need exists for easily allowing transmission of audio and non-audio digital information by either the same or different hardware channels without resulting in higher overhead costs and processing time. Parallel transmission of non-audio digital information in a single time period is also a desirable feature. As well, the digital signal processor should provide digital audio information to an external digital audio receiver, or sink, in one of the industry standard formats, AES-EBU or CP-340.

SUMMARY OF THE INVENTION

The previously mentioned needs are fulfilled with the present invention. Accordingly, there is provided, in one form, a circuit and method for communicating digital audio information. The circuit includes a digital audio source for providing a first plurality of digital audio information values in a first serial data bus format. Each of the first plurality of digital audio information values has a data component and a control component. The circuit also has an interface means for either receiving the first plurality of digital audio information values and transmitting the first plurality of digital audio information values in a second serial data bus format or receiving a second plurality of digital audio information values in the second serial data bus format and transmitting the second plurality of digital audio information values in the first serial data bus format, or both. The second serial data bus format is formed by the interface means by consecutively serially transmitting a data component of a first value of the first plurality of digital audio information values, a data component of a second value of the first plurality of digital audio information values, a control component of the first value of the first plurality of digital audio information values, and a control component of the second value of the first plurality of digital audio information values. The interface means is coupled to the digital audio source for receiving the first plurality of digital audio information values. Furthermore, the circuit has a storage means coupled to the interface means for selectively storing and providing the second plurality of digital audio information values in the second serial data bus format.

These and other features, and advantages, will be more clearly understood from the following detailed description taken in conjunction with the accompanying drawing.

DETAILED DESCRIPTION OF A PREFERRED EMBODIMENT

In a first form, the present invention provides an interface receiver for receiving a plurality of data values in an AES-EBU or CP-340 format, processing the plurality of data values, and communicating the data values in a predetermined format. The receiver described herein concatenates a first four-bit digital non-audio information value corresponding to a left channel audio signal with a second four-bit digital non-audio information value corresponding to a right channel audio signal to form a non-audio information byte. Subsequently, the non-audio information byte is in a form which is commonly used by a data processing system. Therefore, both a serial transmission and a parallel transmission of a non-audio information value is simplified by the present invention. During transmission, each byte of digital data transmitted by the receiver contains either audio of non-audio digital information, and no bits are left unused. The concatenation of the non-audio digital information values of the left channel and right channel audio signals provides the non-audio digital information values in a format which is more readily used by a data processing system, such as a digital signal processor. A minimal number of memory storage, shift or interrupt processing operations are required when the non-audio digital information is provided in a single byte format which may be processed in a single time period.

Figure 1:
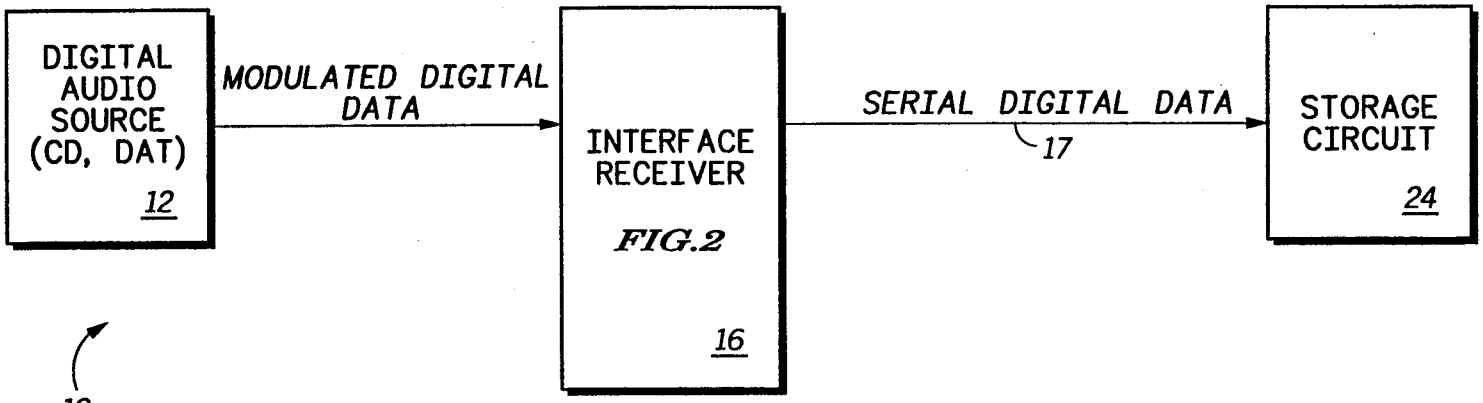
FIG. 1 illustrates in a block diagram form a communications system for transferring digital audio information from a digital audio source to a storage circuit in accordance with the present invention.

Illustrated in FIG. 1 is one implementation of an interface receiver system 10 in accordance with the present invention. Interface receiver system 10 communicates a plurality of digital data values between a digital audio source 12 and a storage circuit 24. Interface receiver system 10 also has an interface receiver 16. The interface receiver 16 generally includes a Manchester decoder 30, a shift register 32, and a shift register 38.

In the implementation of the invention described herein, an output of digital audio source 12 provides a Modulated Digital Data signal to an input of interface receiver 16. Interface receiver 16 subsequently communicates with storage circuit 24 via a Serial Digital Data conductor 17. Interface receiver 16 is illustrated in greater detail in FIG. 1.

In the implementation of the invention illustrated in FIG. 1, digital audio source 12 may be implemented as any digital transmitter such as a compact disc (CD) player or a digital audio tape (DAT) player. Additionally, professional recording equipment may also be used to perform the function provided by digital audio source 12. During operation, an output of digital audio source 12 provides a plurality of digital audio and non-audio information to an input of interface receiver 16 via the Modulated Digital Data signal. The Modulated Digital Data signal transfers the plurality of digital audio and non-audio information in a serial format such as CP-340 or AES-EBU.

In both the CP-340 and AES-EBU formats, the plurality of digital audio and non-audio information is Manchester encoded and transmitted in a series of frames. Manchester encoding allows information transferred in the plurality of digital audio and non-audio information to be contained in a transition from a low value to a high value, or vice versa, in any one period of the source frequency. Each of the plurality of digital audio and non-audio information is typically sampled periodically by a source frequency and formed into either a left or a right channel of two's complement data. The left and the right channel each form a subframe having both audio and non-audio information.

Two subframes, one for left channel information and a second for right channel information, are transmitted in sequence in any one period of the source frequency. The two subframes may also be referred to as a frame. In the CP-340 and AES-EBU formats, each subframe has a predetermined number of time slots, where each time slot corresponds to a data bit of audio or control information. Typically, a first group of data bits of each subframe are preamble bits. Preamble bits are encoded to synchronize receiver system 10 to the source frequency of the digital audio source 12. A second group of data bits of each subframe transfer audio data information in two's complement form. A third group of data bits of each subframe transfers non-audio, or control information. A first non-audio bit is generally referred to as a validity (V) bit. The V bit indicates if the previous audio data information was transmitted to receiver system 10 without any errors. The V bit is a logic zero when the audio data information is valid and a logic one when the audio data information was transmitted with errors. Subsequently, a second non-audio bit is the user (U) data bit. The U bit contains user data which is associated with either the left or right audio channel. A third non-audio bit is the channel status (C) bit. The C bit is sued to form a group of data bits to control transmission of audio and non-audio information. For each one of the left and right audio channels, a block is formed by accessing the C bit of each of 192 successive frames. A start of the block is identified by the preamble of the subframes. A fourth non-audio bit of a subframe is the parity (P) bit. The P bit indicates if the subframe currently transmitted has even parity. Therefore, the P bit is used to easily detect transmission errors and may be used to determine channel reliability.

In interface receiver 16, the Modulated Digital Data signal is connected to Manchester decoder 30 to serially provide the plurality of audio and non-audio information values at a source frequency. Manchester decoder 30 uses the preamble bits of each of the left and right channels of the plurality of digital audio and non-audio information values to synchronize itself to the source frequency of the plurality of audio and non-audio information values. After being synchronized to the source frequency of the plurality of digital information values, Manchester decoder 30 decodes each bit of a remaining portion of the audio and non-audio information to either a logic high or a logic low value. Each of the decoded data values is then serially transferred to an input of shift register 32 by a signal labelled "Decoded Data."

The Decoded Data signal first transfers a first audio and non-audio data value corresponding to a left channel of a predetermined one of the plurality of digital information values provided by the Modulated Digital Data signal to the input of shift register 32. The Decoded Data signal then transfers an audio and a non-audio data value corresponding to a right channel of a predetermined one of the plurality of digital information values to the input of shift register 32. Upon receipt of the audio and non-audio information values corresponding to both the left and right channels of the predetermined one of the plurality of digital information values, shift register 32 transfers a plurality of both left channel and right channel audio information values to a first plurality of inputs of shift register 38. The plurality of left channel audio information values are labelled "ALO" through "ALX," where X is an integer value equal to a predetermined number of left channel audio information values. Similarly, the plurality of right channel audio information values are labelled "ARO" through "ARX." The plurality of left channel and right channel audio information values is transferred in parallel via an Audio Data bus 36. Subsequently, shift register 32 transfers a plurality of both left channel and right channel non-audio information to a second plurality of inputs of shift register 38. The plurality of left channel non-audio information values is labelled "NALO" through "NALY," where Y is an integer value equal to a predetermined number of left channel non-audio information values. Similarly, the plurality of right channel non-audio information values are labelled "NARO" through "NARY." The plurality of left channel and right channel non-audio information is concatenated and transferred in parallel via a Non-audio Data bus 34.

Upon receipt of both the left channel and right channel audio and non-audio information, shift register 38 serially transfers the left channel audio information, the right channel audio information, the left channel non-audio information, and then the right channel non-audio information to storage circuit 24 via the Serial Digital Data conductor 17.

Shift shortage register 38 may be implemented as a conventional shift register circuit. As well, storage circuit 24 may be implemented using a wide variety of circuitry. For example, storage circuit 24 may be implemented as a data processing system with a memory circuit, such as a digital signal processor. Additionally, storage circuit 24 might be implemented as a less complex circuit such as a sigma-delta analog to digital converter.

In a second form, an interface transmitter system 40 is implemented in accordance with the present invention. Interface transmitter system 40 receives a plurality of digital data values in the serial data bus protocol described herein in which a left audio information value, a right audio information value, and then a concatenated non-audio byte are serially transmitted. The interface transmitter then processes the plurality of digital data values and communicates the digital data values to a digital audio receiver, or sink, in either the AES-EBU or CP-340 serial data bus format. The transmitter separates a first digital non-audio information value corresponding to a left channel audio signal from a second digital non-audio information value corresponding to a right channel audio signal. Subsequently, the left channel non-audio information value is concatenated with the left audio information value, the right channel non-audio information value is concatenated with the right audio information value, and the digital information is transferred in accordance with both the AES-EBU and CP-340 serial data bus formats.

Figure 3:
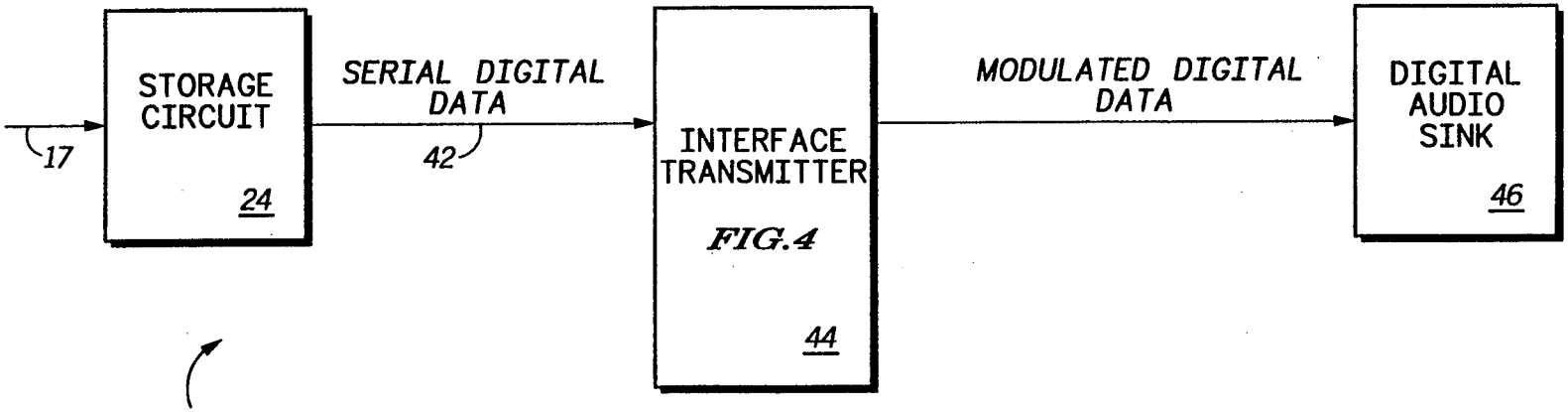
FIG. 3 illustrates in a block diagram form a communications system for transferring digital audio information from a storage circuit to a digital audio sink in accordance with the present invention.
Figure 2:
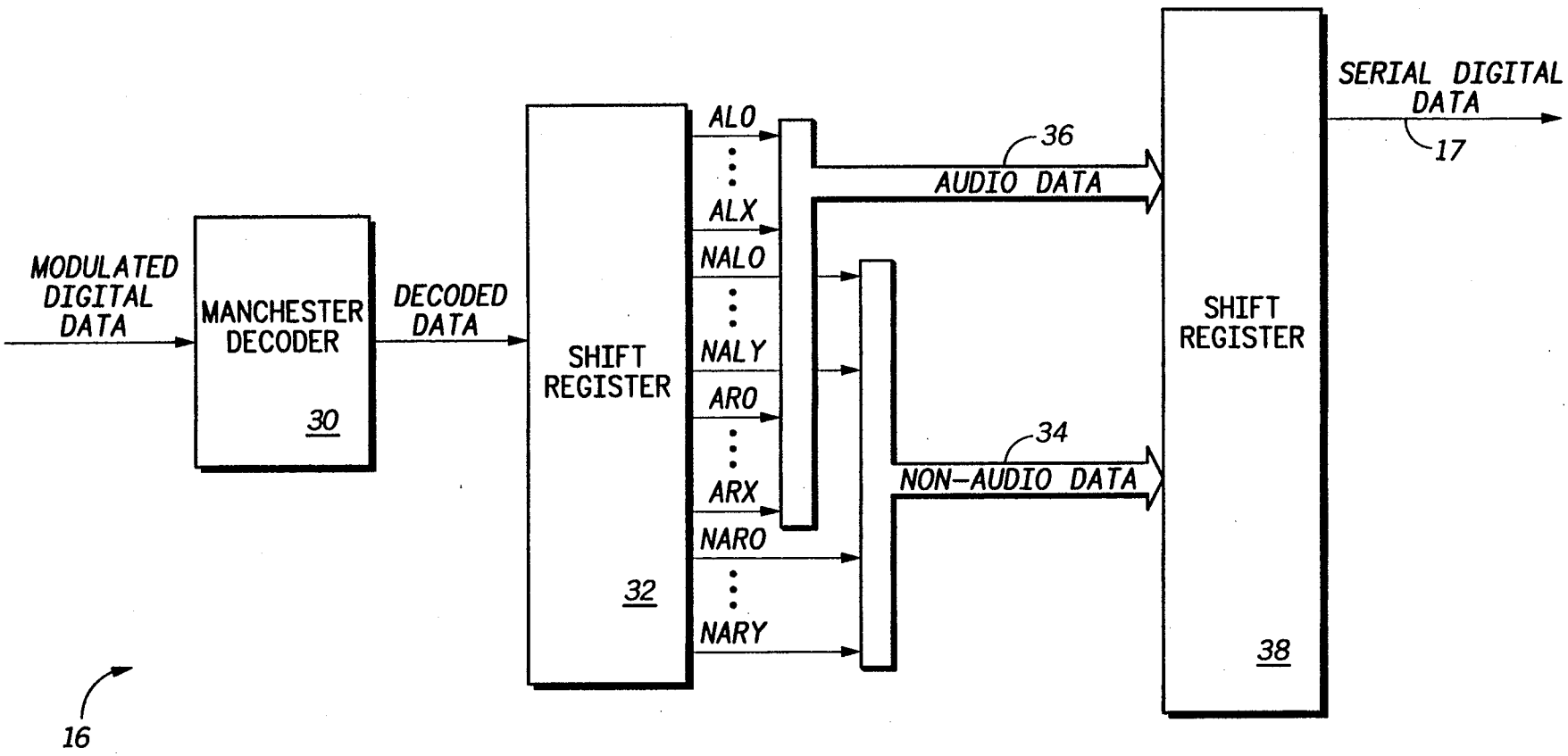
FIG. 2 illustrates in a block diagram form an interface receiver used in the communications system of FIG. 1.

Illustrated in FIG. 3 is an implementation of an interface transmitter system 40 in accordance with a second form of the present invention. Interface transmitter system 40 has a storage circuit 42, an interface transmitter 44, and a digital audio sink 46. Interface transmitter 44 communicates a plurality of digital data values between a storage circuit 42 and a digital audio sink 46. Interface transmitter 44 generally includes a first shift register 48, a second shift register 54, and a modulator 56.

In the second implementation of the invention, a plurality of digital audio information values is transmitted to an input of storage circuit 24 via the Serial Digital Data conductor 17. The plurality of digital audio information values is transmitted in the serial data bus protocol previously discussed. The serial data bus protocol is formed by transmitting the left audio information value, the right audio information value, and then the concatenated non-audio information value. Storage circuit 24 stores each of the plurality of digital audio information values in a predetermined storage location (now shown).

Figure 4:
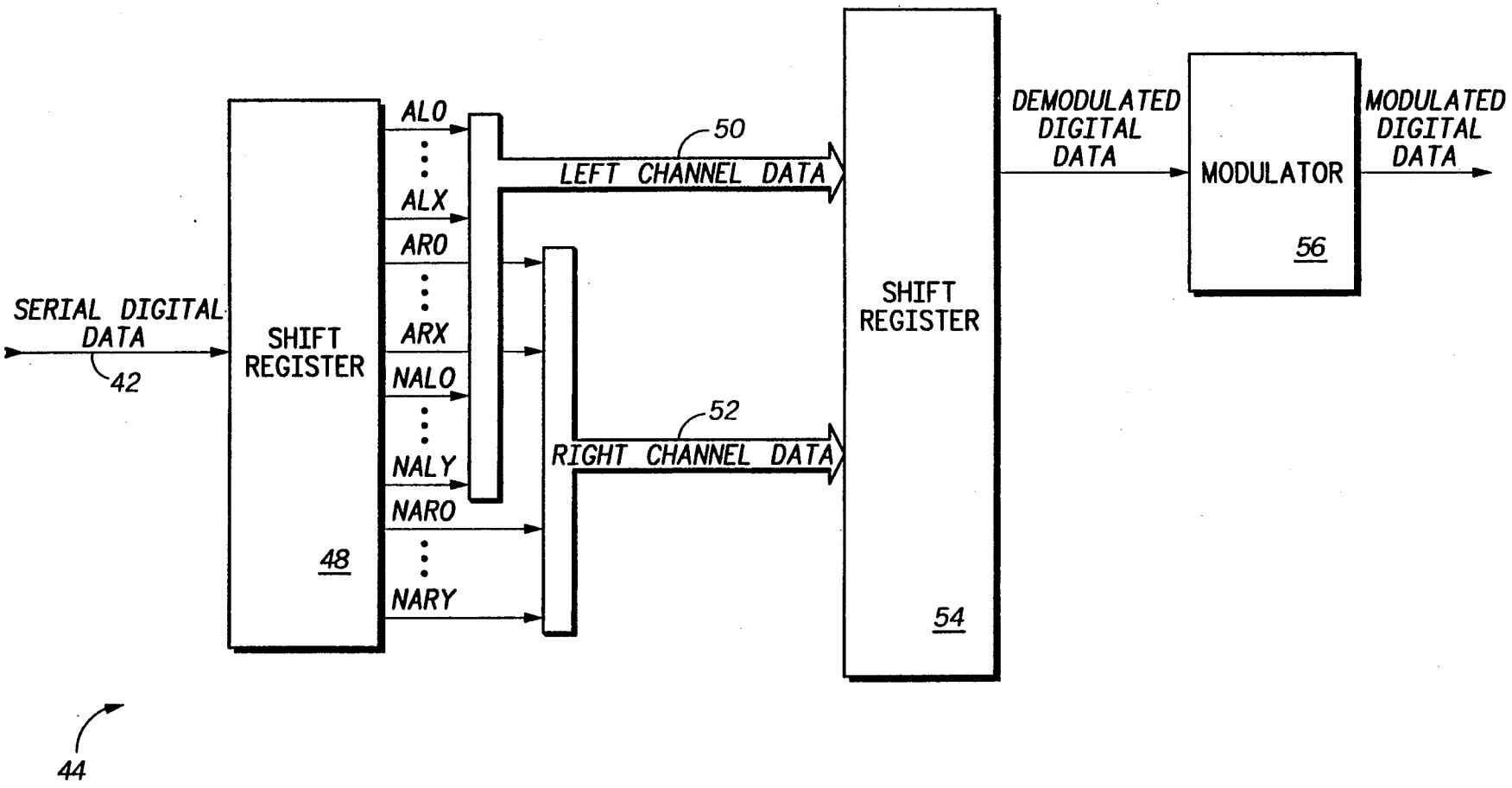
FIG. 4 illustrates in a block diagram form an interface transmitter used in the communications system of FIG. 3.

At a predetermined point in time, storage circuit 24 provides each of the plurality of digital audio information values to an input of interface transmitter 44 via a Serial Digital Data conductor 42. An output of interface transmitter 44 provides a Modulated Digital Data signal to an input of digital audio sink 46. Interface transmitter 44 is illustrated in greater detail in FIG. 4.

In interface transmitter 44, Serial Digital Data conductor 42 is connected to an input of shift register 48. Serial Digital Data conductor 42 serially provides a plurality of digital audio and non-audio information to shift register 48 in the serial format previously discussed.

Upon receiving each of the left and right channel audio and non-audio values, shift register 58 respectively provides a left channel information value and a right channel information value to a first plurality and a second plurality of inputs of the shift register 54. The left channel audio information value is output via a plurality of X signals labelled "ALO" through "ALX." Similarly, the left channel non-audio information value is output via a plurality of Y signals labelled "NALO" through "NALY." X is an integer value equal to a predetermined number of audio information values, and Y is an integer value equal to a predetermined number of non-audio information values. Additionally, the right channel audio information value is output via a plurality of X signals labelled "ARO" through "ARX," and the right channel non-audio information value is output via a plurality of Y signals labelled "NARO" through "NARY."

The plurality of left channel audio and non-audio information values, respectively transferred by the ALO through ALX signals and the NALO through NALY signals, are concatenated and subsequently transferred in parallel to the first plurality of inputs of shift register 54. The concatenated left channel information values are transferred via a Left Channel Data bus 50. As well, the plurality of right channel audio and non-audio information values, respectively transferred by the ARO through ARX signals and the NARO through NARY signals, are concatenated and also transferred in parallel to the second plurality of inputs of shift register 54. The concatenated right channel information values are transferred via a Right Channel Data bus 52.

Upon receipt of both the concatenated left and right channel information values, shift register 54 serially transmits each of the left and right channel information values to an input of modulator 54 by a signal labelled "Demodulated Digital Data." The Demodulated Digital Data signal provides the information values to modulator 56 in an AES-EBU or CP-340 serial data bus format such that the left channel audio and non-audio information values are first transmitted, and then the right channel audio and non-audio information values are transmitted.

Modulator 54 modulates the digital audio information values transferred via the Demodulated Digital Data signal to provide a signal labelled "Modulated Digital Data." The digital audio information values transferred via the Modulated Digital Data signal are transmitted to the digital audio sink 46 in either the AES-EBU or CP-340 serial data bus format.

There has been provided herein, a circuit for communicating a plurality of digital audio and non-audio data values in a predetermined serial data bus format. In the example described herein, the predetermined serial data bus format requires the transfer of audio data corresponding to a left channel, the transfer of digital audio data corresponding to a right channel, and then the transfer of one byte of digital non-audio data corresponding to both the left and right channels.

The non-audio component of each of the left and right channels typically has four bits. Therefore, when combined, the concatenated non-audio information value forms a byte. Because each bit in the byte of digital non-audio data is used to transfer information, the predetermined serial bus protocol described herein provides a very efficient method for transferring non-audio data. No bits are wasted in the transfer of both left and right channel non-audio information. Additionally, because the non-audio information is transferred in a byte form, a software interface program which is typically used to store and process the left and right channels of non-audio information separately, may now process the left and right channels of non-audio information at the same time. Therefore, less processing time is typically used to service the non-audio data. The processing time saved may often be critical in a real-time data processing system.

Additionally, because the non-audio information is transferred in a byte form, the byte of non-audio information may be easily received either serially or in parallel by the storage circuit 24. When transferred in parallel, a single transfer of non-audio will take only one period of the source frequency, as opposed to two or more periods which would be required if the left and right channels of the non-audio data were transferred separately. As well, when transferred in a byte format, the control complexity of interfacing with a simple hardware system is simplified. For example, assume that information is only read from storage circuit 24. Therefore, storage circuit 24 may be implemented as a read only memory (ROM). A clock signal and a signal indicating the start of a block of a predetermined plurality of digital data values would suffice to transfer non-audio data from storage circuit 24 to the interface transmitter system 40. If the non-audio data is transferred at two separate times, additional control signals will be required to indicate when the non-audio data associated with the left channel is transferred and when the non-audio data associated with the right channel is transferred. Therefore, the byte format of the concatenated left and right channel non-audio information simplifies the transfer of information from simple hardware systems, such as a ROM or an EPROM (electrically programmable read only memory).

The byte format of the non-audio data may also be easily implemented in a time division multiplexed system. A time division multiplexed system allows for a first predetermined type of information to be provided to an input or a plurality of inputs of a data processing system at a predetermined point in time. Then, a second predetermined type of information is provided to the same input or the same plurality of inputs of the data processing system at a second predetermined point in time. In this case, audio information is provided at the first point in time, and non-audio information is provided at the second point in time. Typically, data processing systems which support time division multiplexing have time slot lengths which are some multiple of eight bits, or a byte. Therefore, the audio and non-audio information may be input via the same pins of the data processing system. If the non-audio data is transferred separately, a separate and usually awkward interface is required to allow the non-audio data to be input via the same pins. Again, additional control signals or a complex software interface program would be required to enable the data processing system to receive the left and right channels of the non-audio information.

If storage circuit 24 is implemented as a digital signal processor, the byte format of the non-audio information works well with the serial protocol of the serial communication interface standard determined by the industry. In particular, the serial communication interface standard has a gated clock with eight sampling edges. Therefore, the eight bits of the byte of non-audio information are received in the digital signal processor without the addition of extra shift, mask and logic operations typically needed to separate the audio information from the non-audio information. As well, many digital signal processors store digital audio and non-audio information a byte at a time. Therefore, the byte format of the non-audio information described herein might be easily processed by the digital signal processor.

The serial protocol in which the left channel and right channel non-audio information values are concatenated for form a byte of non-audio information provide a unique and efficient method for communicating digital audio and non-audio information from a digital audio source to a storage or processing circuit. Digital audio and non-audio information is transferred to the storage or processing circuit in a form which is readily useable. The storage or processing circuit must no longer provide a hardware interface circuit or a software program to compensate for the separate transmission of the left channel and right channel non-audio information.

It should be well understood that both the receiver interface system 10 illustrated in FIG. 1 and the transmitter interface system 40 illustrated in FIG. 3 allow for more efficient communication between a digital audio source and a storage circuit, or a data processing system by providing an efficient serial audio data bus protocol. The implementations of the invention described herein are provided by way of example only, however, and many other implementations may exist for executing the function described herein. For example, the receiver interface system 10 and the transmitter interface system 40 might be combined and implemented within the same circuit as a transceiver circuit. Additionally, digital audio source 12 may be implemented as any source of digital audio information. A compact disc player, a digital audio tape player, or a transmitter for professional recordings would all function equally well in the implementation of the invention described above. In Manchester decoder 30, a standard implementation of a Manchester decoder may be used. Additionally, conventional implementations of a shift register may be used to implement shift registers 32, 38, 48, and 54. Storage circuit 24 may be implemented in a wide variety of circuits. For example, storage circuit 24 may be implemented as any data processing system having memory. As well, storage circuit 24 may be implemented in complexity from a system as simple as a ROM to a more complex system such as a digital-signal-processor. A sigma-delta analog to digital converter may also be used as to implement the storage circuit 24. Additionally, modulator 56 may be implemented using a standard modulator circuit.

Additionally, in the implementation of the invention described herein, the serial protocol of the plurality of digital data values provided by interface receiver 16 in FIG. 1 and by the storage circuit 24 in FIG. 3 is formed by sequentially serially transferring the left channel audio information value, the right channel audio information value, and then the concatenated non-audio information value via Serial Digital Data conductor 17. In another implementation of the invention, the concatenated non-audio information value might be transferred without either of the left or right channel audio information values. Additionally, the concatenated non-audio information value might also be transferred in parallel while either one or both of the left and right channel audio values are serially transferred. A wide variety of methods may be implemented for transferring the left channel audio information value, the right channel audio information value, and the concatenated non-audio information value.

While there have been described herein the principles of the invention, it is to be clearly understood to those skilled in the art that this description is made only by way of example and not as a limitation to the scope of the invention. Accordingly, it is intended, by the appended claims, to cover all modifications of the invention which fall within the true spirit and scope of the invention.

We claim:

1. A circuit for communicating digital audio information, a digital audio source for providing a plurality of modulated digital audio values in a first data format, each of the plurality of modulated digital audio values having a data component and a control component;

interface means for receiving the plurality of modulated digital audio values and transmitting the plurality of modulated digital audio values in a second data format, the second data format formed by the interface means by selectively transmitting at least a concatenated control value, the interface means forming the concatenated control value by concatenating a control component of a first one of the plurality of modulated digital audio values and a control component of a second one of the plurality of modulated digital audio values, the interface means being coupled to the digital audio source for receiving the plurality of modulated digital audio information values; and storage means coupled to the interface means for storing the plurality of modulated digital audio values in the second data format.

2. The circuit for communicating digital audio information of claim 1 wherein the first data format is compatible with a CP-340 format.

3. The circuit for communicating digital audio information of claim 1 wherein the first data format is compatible with an AES-EBU format.

4. The circuit for communicating digital audio information of claim 1 wherein the first one of the plurality of modulated digital audio values corresponds to a left audio channel value and the second one of the plurality of modulated digital audio values corresponds to a right audio channel value.

5. The circuit for communicating digital audio information of claim 1 wherein the control components of the first and second ones of the plurality of modulated digital audio values are consecutively serially transmitted to the storage means by the interface means.

6. The circuit for communicating digital audio information of claim 1 wherein the interface means further comprises:

input means for receiving the plurality of digital audio values in the first data format;

first means for storing the control component of each of the first and the second ones of the plurality of modulated digital audio values, the first means for storing being coupled to the input means for receiving the control components of each of the first and second ones of the plurality of modulated digital audio values;

a first communication bus coupled to the first means for storing, the first communication bus having a plurality of parallel conductors for transferring the control components of each of the first and second ones of the plurality of modulated digital audio values from the first means for storing as the concatenated control value;

second means for collectively storing the control components of the first and second ones of the plurality of modulated digital audio values, the second means for collectively storing being coupled to the plurality of parallel conductors for receiving the concatenated control value; and a second communication bus coupled to the second means for collectively storing for receiving the concatenated control value, the second communication bus transferring the concatenated control value to establish the second data format.

7. A method for communicating digital audio information comprising the steps of:

receiving a plurality of modulated digital audio values in a first data format, each one of the plurality of modulated digital audio information values having a data component and a control component;

converting the plurality of modulated digital audio values in the first data format to a second data format, the second data format having a concatenated control value formed by concatenating a control component of a first one of the plurality of digital audio values and control component of a second one of the plurality of modulated digital audio values;

serially transmitting the plurality of digital audio values in the second data format; and storing the plurality of modulated digital audio values in the second data format.

8. The method of claim 7 wherein the second data format further comprises either one of a data component of the first one of the plurality of modulated digital audio values or a data component of the second one of the plurality of modulated digital audio values, or both.

9. The method of claim 7 wherein the first one of the plurality of modulated digital audio values corresponds to a left audio channel value and the second one of the plurality of modulated digital audio values corresponds to a right audio channel value.

10. The method of claim 7 wherein the step of converting the plurality of modulated digital audio values further comprises the steps of:

storing the control component of each of the first and the second ones of the plurality of modulated digital audio values in a first storage means;

coupling a first communication bus to the first storage means, the first communication bus having a plurality of parallel conductors for transferring the control components of each of the first and the second ones of the plurality of modulated digital audio values to form the concatenated control value;

collectively storing the concatenated control value in a second storage means, the second storage means being coupled to the plurality of parallel conductors of the first communication bus for receiving the concatenated control value; and coupling a second communication bus to the second storage means, the second communication bus transferring the concatenated control value to establish the second data format.

11. A circuit for communicating digital audio information, comprising:

storage means for providing a plurality of unmodulated digital audio information values in a first data format, wherein each one of the plurality of unmodulated digital audio information values has a data component and a control component, the first data format comprising a data component of a left audio channel value of a first one of the plurality of unmodulated digital audio information values, a data component of a right audio channel value of the first one of the plurality of unmodulated digital audio information values, and a concatenated control value, the concatenated control value formed by a control component of the left audio channel value and a control component of the right audio channel value;

interface means for receiving the plurality of unmodulated digital audio information values in the first data format and transmitting the plurality of unmodulated digital audio information values in a second data format, the second data format being a data format which is compatible with either a CP-340 format or an AES-EBU format, or both; and a digital audio sink coupled to the interface means for receiving the plurality of unmodulated digital audio information values in the second data format.

12. The circuit for communicating digital audio information of claim 11 wherein the control component of the left audio channel and the control component of the right audio channel are concurrently transmitted in parallel by the interface means.

13. The circuit for communicating digital audio information of claim 11 wherein the interface means further comprises:

input means for receiving the plurality of unmodulated digital audio information values in the first data format;

first storage means coupled to the input means for storing a first and a second one of the plurality of the unmodulated digital audio information values;

a first communication bus coupled to the first storage means, the first communication bus having a first portion of parallel conductors for transferring the data and control components of the first one of the plurality of unmodulated digital audio information values and having a second portion of parallel conductors for transferring the data and control components of the second one of the plurality of unmodulated digital audio information values;

second storage means for storing and providing the data and control components of each of the first and second ones of the plurality of unmodulated digital audio information value, the second storage means having a first plurality of inputs coupled to the first portion of parallel conductors of the first communication bus for receiving the data and control components of the first one of the plurality of unmodulated digital audio information values and having a second plurality of inputs coupled to the second portion of parallel conductors of the first communication bus for receiving the data and control components of the second one of the plurality of unmodulated digital audio information values; and a second communication bus coupled to the second storage means for receiving the data and control components of the first and second ones of the plurality of unmodulated digital audio information values in the second data format.

14. A method for communicating digital audio information comprising the steps of:

serially receiving a plurality of unmodulated digital audio values in the first data format, each one of the plurality of unmodulated digital audio information values having a data component and a control component, the first data format comprising a concatenated control value formed by concatenating a control component of a first one of the plurality of unmodulated digital audio values and control component of a second one of the plurality of unmodulated digital audio values;

converting the plurality of unmodulated digital audio values in the first data format to a second data format, the second data format being a data format which is compatible with either a CP-340 format or an AES-EBU format, or both; and transmitting the plurality of digital audio values in parallel in the second data format.

15. The method of claim 14 wherein the first data format further comprises either one of a data component of the first one of the plurality of unmodulated digital audio values or a data component of the second one of the plurality of unmodulated digital audio values, or both.

16. The method of claim 14 wherein the first one of the plurality of unmodulated digital audio values corresponds to a left audio channel value and the second one of the plurality of unmodulated digital audio values corresponds to a right audio channel value.

17. The method of claim 14 wherein the step of converting the plurality of unmodulated digital audio values further comprises the steps of:

storing the a control component of each of a first and a second ones of the plurality of unmodulated digital audio values in a first storage means;

coupling a first communication bus to the first storage means, the first communication bus having a plurality of parallel conductors for transferring the data and control components of each of the first and the second ones of the plurality of unmodulated digital audio values;

collectively storing the data and control components of each of the first and the second ones of the plurality of unmodulated digital audio values int he second data format in a second storage means, the second storage means being coupled to the plurality of parallel conductors of the first communication bus for receiving the data and control components of each of the first and the second ones of the plurality of unmodulated digital audio values; and coupling a second communication bus tot he second storage means, the second communication bus transferring the data and control components of each of the first and the second ones of the plurality of unmodulated digital audio values in the second data format.

* * * * *

UNITED STATES PATENT AND TRADEMARK OFFICE

CERTIFICATE OF CORRECTION

PATENT NO. : 5,214,705

DATED : May 25, 1993

INVENTOR(S) : Kevin L. Kloker, et al.

It is certified that error appears in the above-identified patent and that said Letters Patent is hereby corrected as shown below:

Column 14, line 53, change "int he" to --in the--.

Column 14, line 60, change "tot he" to --to the--.

Signed and Sealed this

Third Day of May, 1994

Bruce Lehman

*Attest:*

BRUCE LEHMAN

*Attesting Officer*

*Commissioner of Patents and Trademarks*